US006827609B1

(12) United States Patent
Martin et al.

(10) Patent No.: US 6,827,609 B1
(45) Date of Patent: Dec. 7, 2004

(54) ELECTRICAL CONNECTOR HAVING IMPROVED TERMINAL POSITIONING ASSURANCE MEMBER

(75) Inventors: Galen M. Martin, Camp Hill, PA (US); Eric D. Shields, High Point, NC (US); Ralph T. Bentley, II, Belews Creek, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/706,402

(22) Filed: Nov. 12, 2003

(51) Int. Cl.[7] ..... H01R 13/40
(52) U.S. Cl. ..... 439/595
(58) Field of Search ..... 439/595, 752, 439/352, 353, 354, 357, 488, 489

(56) References Cited

U.S. PATENT DOCUMENTS 5,622,521 A * 4/1997 Marceau et al. ..... 439/595
5,746,624 A * 5/1998 Ohsumi et al. ..... 439/595
6,116,953 A 9/2000 Myer ..... 439/595
6,364,692 B1 * 4/2002 Okayasu et al. ..... 439/426
6,475,014 B2 * 11/2002 Tsuji et al. ..... 439/352
6,478,620 B1 * 11/2002 Bonavita et al. ..... 439/595
6,514,098 B2 * 2/2003 Marpoe et al. ..... 439/352
6,572,394 B1 * 6/2003 Yamaoka et al. ..... 439/188
6,579,118 B2 * 6/2003 Endo ..... 439/489
6,685,500 B2 * 2/2004 Nakamura ..... 439/489
6,688,907 B2 * 2/2004 Yamaoka et al. ..... 439/489
6,736,675 B2 * 5/2004 Kato et al. ..... 439/595

* cited by examiner

*Primary Examiner*—Ross Gushi
*Assistant Examiner*—Phuongchi Nguyen

(57) ABSTRACT

An electrical connector assembly is disclosed having an insulative housing and insulative terminal positioning assurance member. The terminal positioning assurance member has a prelatched position where corresponding latches abut, preventing inadvertent activation and locking of the terminal positioning assurance member. The terminal includes a projection which engages the terminal positioning assurance member, allowing the terminal positioning assurance member to move to a fully locked position.

20 Claims, 10 Drawing Sheets

ELECTRICAL CONNECTOR HAVING IMPROVED TERMINAL POSITIONING ASSURANCE MEMBER

FIELD OF THE INVENTION

The invention is directed to electrical connectors and more particularly to electrical connectors having a terminal positioning assurance member.

BACKGROUND OF THE INVENTION

In various applications of electrical connectors, devices are utilized to lock the terminals in place and to assure that they are in proper position within the electrical connector. One such field is in the automotive field where the application typically requires a so-called secondary locking system, that is, a redundant retention system for locking the terminals in place, as well as a terminal position assurance mechanism (TPA) which assures that the terminals are proper position longitudinally within the respective cavities. This prevents a proper mating of a corresponding electrical connector, where some of the lines are open due to one or more terminals not being fully loaded.

Certain electrical connectors are provided with housings having cavities extending therethrough for receiving terminals, each cavity provided with a resilient locking lance integrally molded with the housing for locking a terminal inserted therein. In order to further secure the terminals within the housing, it is common to provide a secondary housing member that is moveable against the locking lances to prevent the locking lances from outwardly biasing. In other words, the locking lances are blocked into their latching position. It is known to provide the secondary member pre-assembled to the housing in a pre-assembly position that allows insertion of the terminals into the connector cavities. The secondary member can then be moved to a fully locked position whereby the terminals are locked in the cavities.

In essence, these TPAs constitute front-loaded wedges that are shipped in a pre-stage position, which are intended to be activated, or moved into their final position, after the terminals are assembled into the housing. The TPA has a pre-locked position, but the TPA senses a partially inserted terminal, not the absence of a terminal. Traditionally, these connectors are shipped in bulk to the end user or harness maker, where the wire harnesses are made, wires crimped to the terminals, and terminals inserted into the housing cavities. Thereafter, the TPA member is moved into the final position. However, one of the difficulties with such system is that these systems tend to become locked during shipping, and the customer is left with the task of attempting to dislodge the TPA from the final locked position.

The objects of the invention are to improve upon the above mentioned systems.

SUMMARY OF THE INVENTION

The invention was accomplished by providing an electrical connector having a housing having at least one terminal receiving cavity extending from a rear wire entry to a front face of the housing. The housing has a front latching member extending forwardly adjacent to the front face, and the front latching member has a front leading end. A terminal positioning assurance member slidably is receivable over the front face of the housing, the terminal positioning assurance member including a rearwardly facing, flexible latch member having a rearwardly facing stop surface aligned with the front leading end of the front latch member. An electrical terminal member is also receivable into the terminal receiving cavity, the electrical terminal having a raised projection which is profiled for engaging and biasing outwardly, the rearwardly facing stop surface of the flexible latch member. The terminal positioning assurance member is held in a pre-assembled position where the rearwardly facing stop surface of the flexible latch member abuts the front leading end of the front latch member, until the terminal is inserted into the cavity to a position where the raised projection deflects the flexible latch member, and the flexible latch passes over, and locks behind the front latching member in a fully assembled position.

The front latching member is defined by two spaced apart walls cantilevered from the housing, with a latching bar spanning between the walls, the flexible latching member locking to the latching bar in the fully assembled position. The latching bar includes a ramped surface on a lower edge thereof, which is profiled for engaging said raised projection on the terminal. The flexible latch member is defined by a cantilevered latch arm having a ramped surfacing sloping rearwardly upwardly, the ramping surface being profiled for engaging the latching bar and assisting in the deflection on the cantilevered latch arm over the latching bar.

The connector further comprises cooperable latching elements on the housing and terminal positioning assurance member to latch the housing and terminal positioning assurance member in the pre-assembled position. The cooperable latching elements are comprised of a cantilevered latching arm extending from the terminal positioning assurance member, engageable with a shoulder on the housing.

The terminal receiving cavity has an open upper face, and the front latching member extending partially over the open upper face, and the rearwardly facing, flexible latch member extending over the open upper face from an opposite position.

The electrical terminal includes a forward contact area, a wire crimp section and a strain relief section, the raised projection extending upwardly from the forward contact section. The electrical terminal includes an inner contact member and an outer protective box-shaped cover, the raised projection extending upwardly from the outer protective box-shaped cover. The raised projection is comprised of a rearwardly extending ramped surface and a top surface.

In another aspect of the invention, an electrical connector, comprises a housing having at least one terminal receiving cavity extending from a rear wire entry to a front face of the housing, an electrical terminal member receivable into the terminal receiving cavity, and a terminal positioning assurance member slidably receivable over the front face of the housing. The housing has a front latching member extending forwardly adjacent to the front face, the front latching member having a front leading end, the terminal positioning assurance member including a rearwardly facing, flexible latch member having a rearwardly facing stop surface aligned with the front leading end of the front latch member. The terminal positioning assurance member is held in a pre-assembled position where the rearwardly facing stop surface of the flexible latch member abuts the front leading end of the front latch member, until the terminal is inserted into the cavity to a position where the terminal deflects the flexible latch member, and the flexible latch passes over, and locks behind the front latching member in a fully assembled position.

The electrical terminal includes a raised projection being profiled for engaging and biasing outwardly, the rearwardly facing stop surface of the flexible latch member. The electrical terminal includes a forward contact area, a wire crimp section and a strain relief section, the raised projection extending upwardly from the forward contact section. The electrical terminal includes an inner contact member and an outer protective box-shaped cover, the raised projection extending upwardly from the outer protective box-shaped cover. The raised projection is comprised of a rearwardly extending ramped surface and a top surface.

The front latching member is defined by two spaced apart walls cantilevered from the housing, with a latching bar spanning between the walls, the flexible latching member locking to the latching bar in the fully assembled position. The flexible latch member is defined by a cantilevered latch arm having a ramped surfacing sloping rearwardly upwardly, the ramping surface being profiled for engaging the latching bar and assisting in the deflection on the cantilevered latch arm over the latching bar.

The electrical connector further includes cooperable latching elements on the housing and terminal positioning assurance member to latch the housing and terminal positioning assurance member in the pre-assembled position. The cooperable latching elements are comprised of a cantilevered latching arm extending from the terminal positioning assurance member, engageable with a shoulder on the housing.

The terminal receiving cavity has an open upper face, and the front latching member extending partially over the open upper face, and the rearwardly facing, flexible latch member extending over the open upper face from an opposite position.

DETAILED DESCRIPTION OF THE PREFERRED EMBODIMENT

Figure 1:
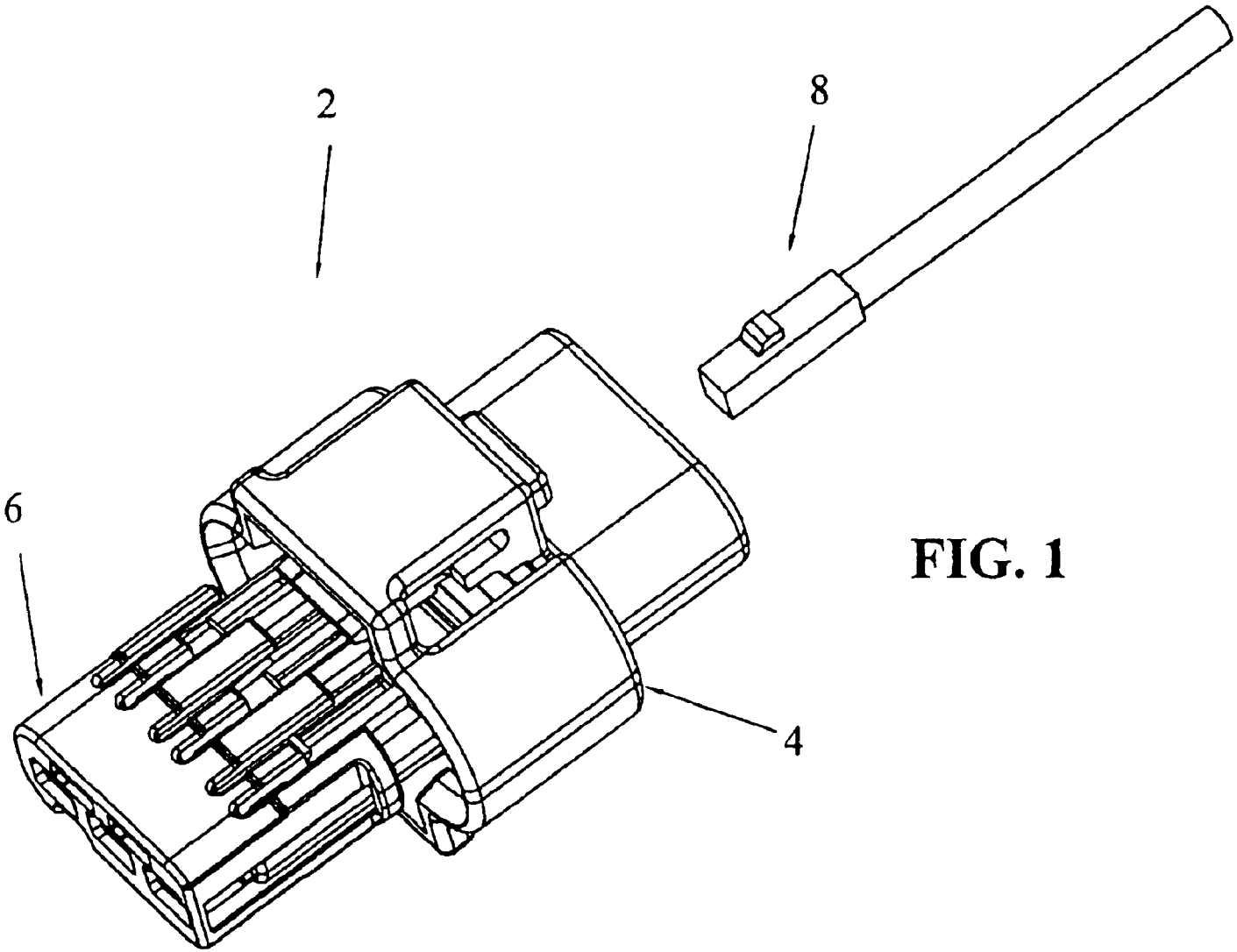
FIG. 1 is a perspective view of the housing of the present invention, with the terminal position assurance member in a preassembled position shown poised for receipt of a contact member.
Figure 2:
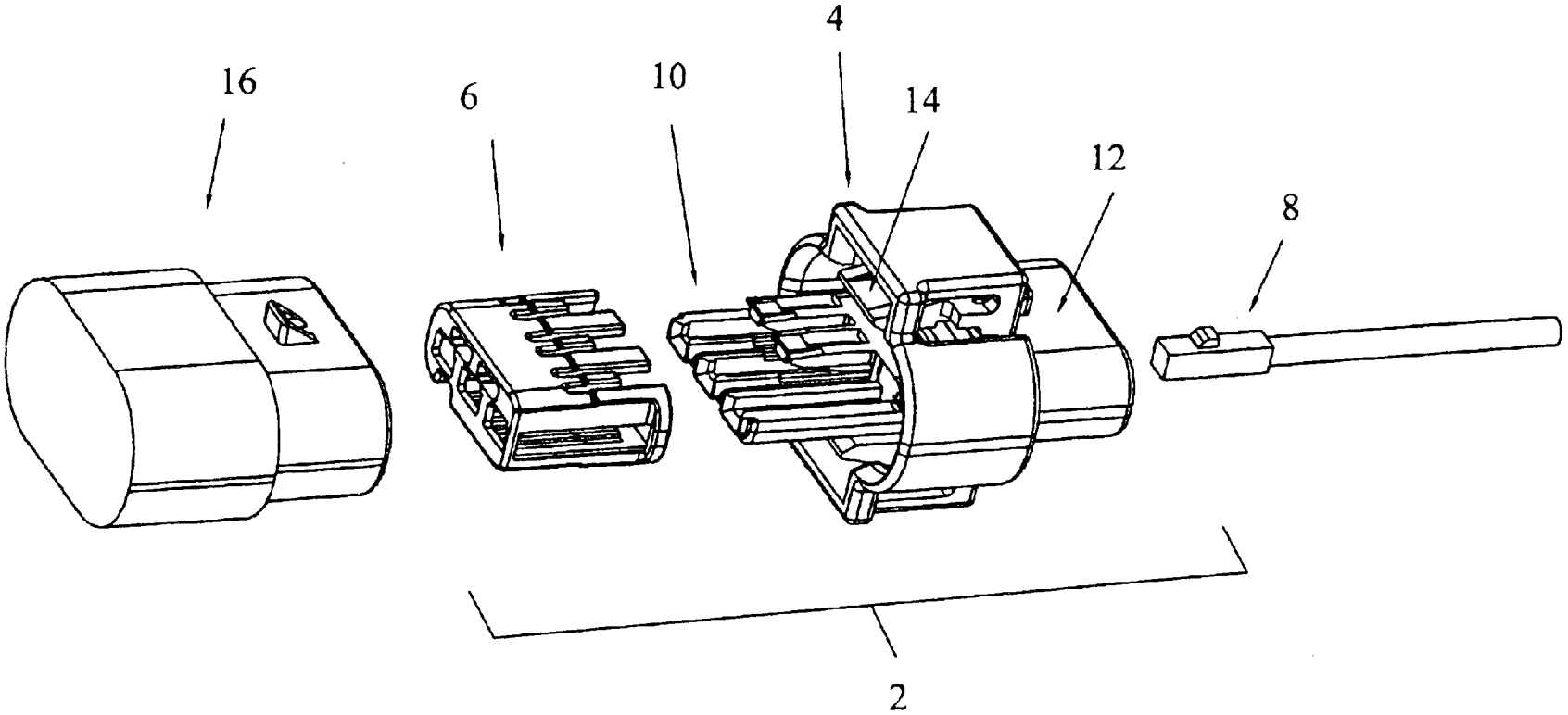
FIG. 2 is a perspective view similar to that of FIG. 1, showing the terminal position assurance member exploded from the housing and also shown poised for receipt of a mating connector.

With respect first to FIG. 1, an electrical connector is shown at 2 having a housing member shown generally at 4 having a terminal position assurance member 6 latched in a preassembled position, for receipt of an electrical terminal or contact member 8. As shown in FIG. 2, the connector generally includes a forward terminal platform 10, a rear wire entry section 12, and a latch 14 for latching to a complementary electrical connector 16, as will be described herein.

Figure 2A:
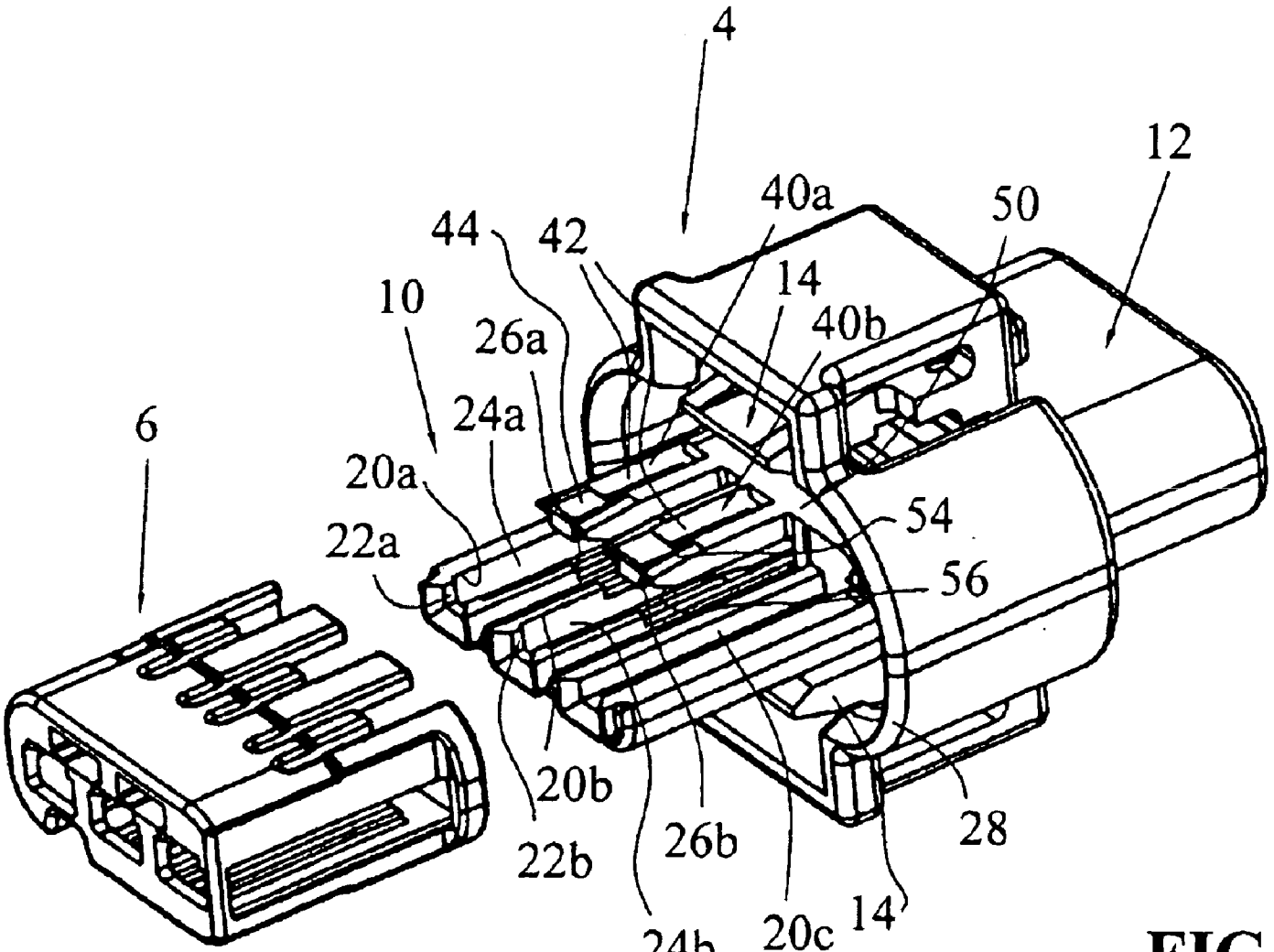
FIG. 2A is a view similar to that of FIG. 2, showing an enlarged view of the housing and terminal position assurance member enlarged.

With reference now to FIG. 2A, housing 4 will be described in greater detail. As shown, the forward terminal platform 10 includes a plurality of terminal channels, such as 20*a*, 20*b* and 20*c*. Each of the terminal-receiving channels 20*a* and 20*b* includes a terminal-receiving opening 22*a* and 22*b*. Channel 20*c* in this embodiment is designed for receiving an alternate terminal configuration, than that of channels 20*a* and 20*b*. The channels also include open upper faces 24*a* and 24*b*, with the channels including rearwardly facing latching surfaces 26*a* and 26*b*. Housing 4 also includes a peripheral shroud 28, which surrounds the terminal platform 10 and latches 14 and is profiled to receive mating connector 16.

Figure 3:
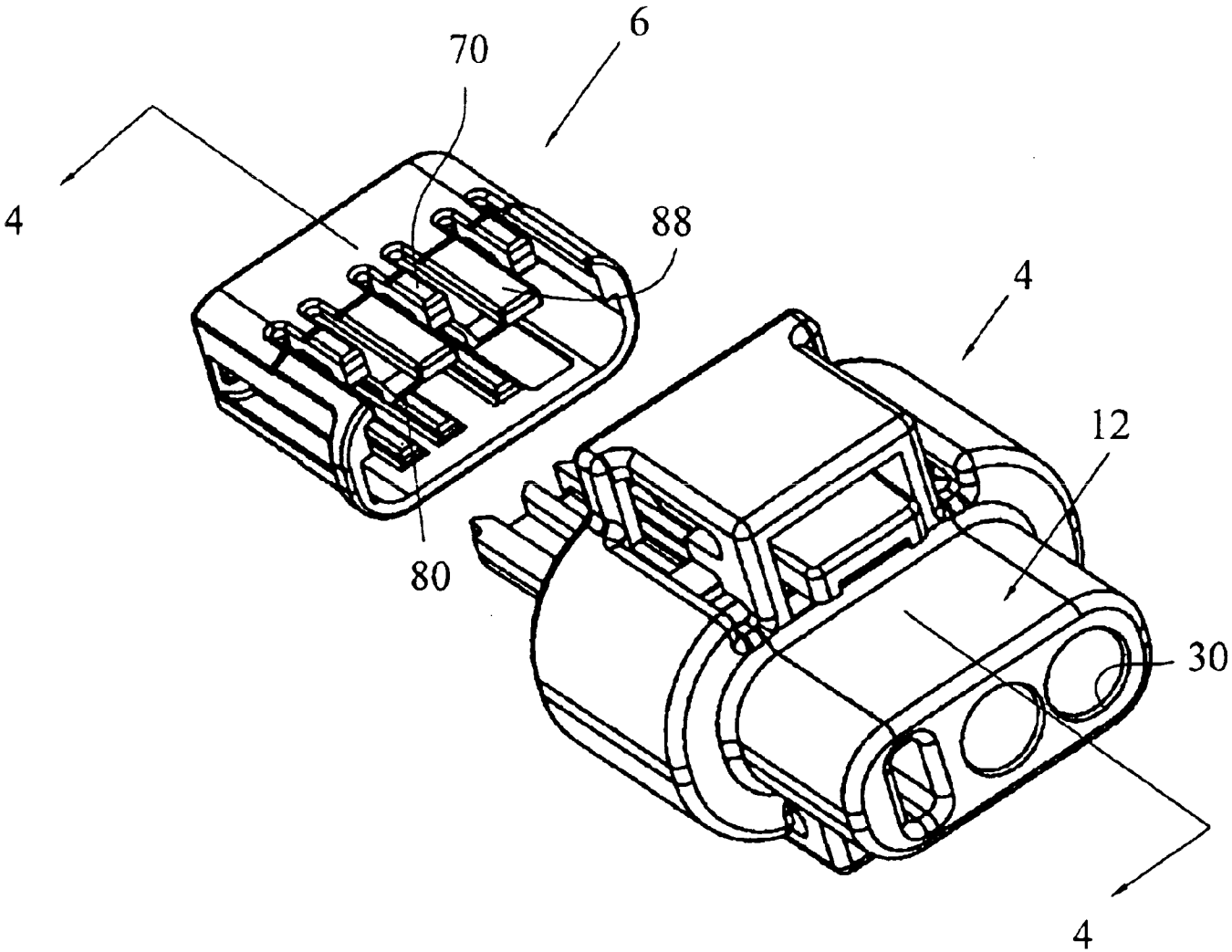
FIG. 3 is a view similar to that of FIG. 2 from a different perspective.
Figure 4:
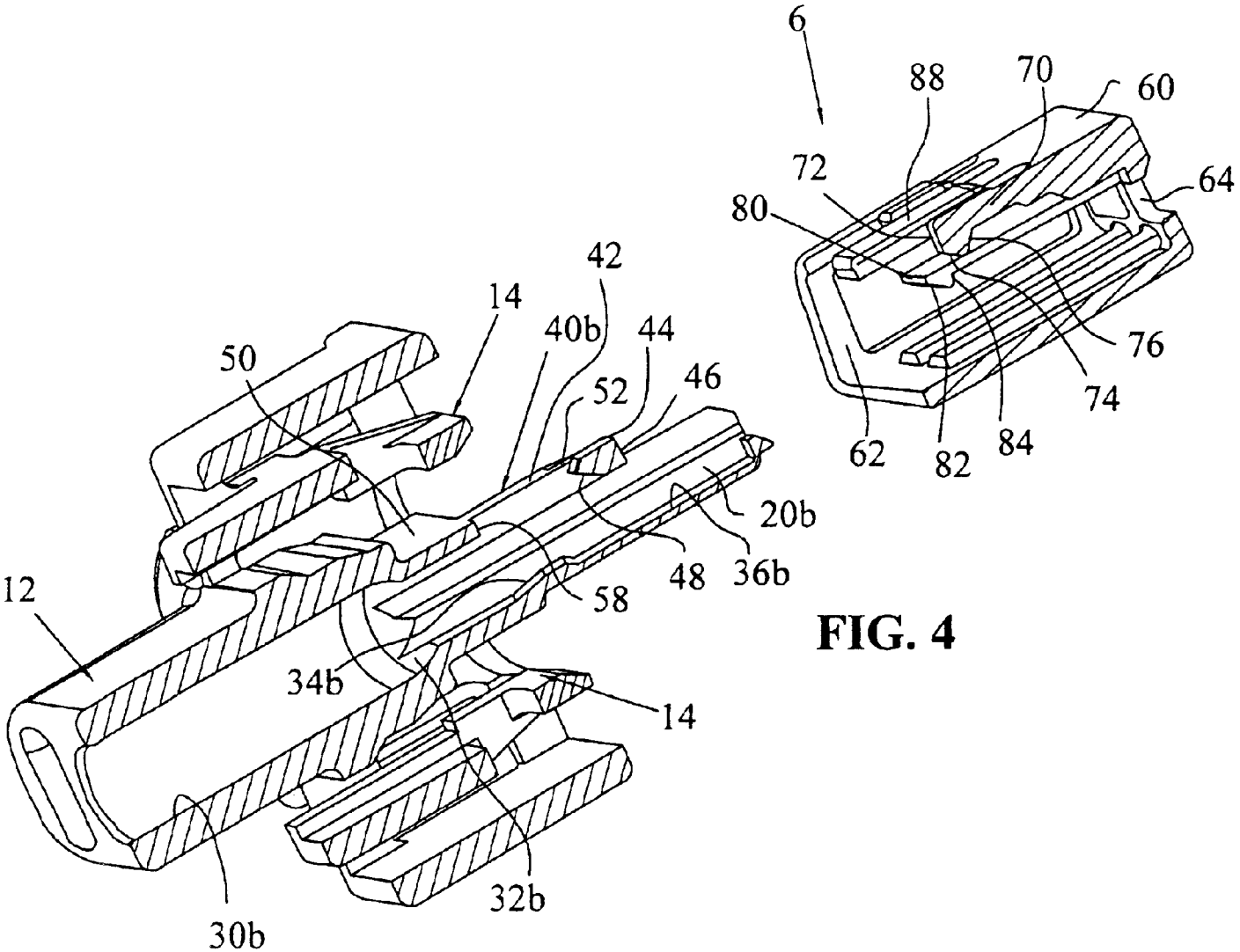
FIG. 4 is a cross-sectional view through lines 4—4 of FIG. 3.

With respect now to FIG. 3, housing 4 includes a plurality of rear wire openings 30, and as shown in FIG. 4, channel 20*b* is shown extending rearwardly and intersecting a wire-receiving opening at 30*b*. Wire opening 30*b* transitions to a reduced cross-section through sections 32*b* and 34*b*. Section 34*b* transitions to section 36*b*. As shown best in FIG. 2A, housing 4 further includes latching members 40*a* and 40*b*, lying respectively over channels 20*a* and 20*b*. Each of the latching members include parallel members extending forwardly from a central body portion 50 of the housing, for example, latch 40*a* includes parallel extensions 42, with a bar portion 44 expanding therebetween. Latch 40*b* is identical to latch 40*a*, and the latches are seen more clearly in the cross-sectional view of FIG. 4. Latch 40*b* is shown with extension portion 42 extending forwardly from the central body portion 50 and with latching bar 44 in cross section. Latching bar 44 has a front leading end 46, a ramped surface 48, and a latching surface 52. The front end of latch extension walls 42 also includes downwardly sloped sections 54 and a ramped surface at 56. Furthermore, central body portion 50 includes a front edge 58 facing forwardly.

With respect still to FIG. 4, terminal position assurance member 6 includes a front housing portion 60, a rearward shroud portion 62, and a plurality of apertures 64 aligned with the respective channels 20*a*, 20*b* and 20*c*. Member 6 also includes a rearwardly extending latch member 70 having a rearwardly facing stop surface 72, a camming surface 74, and a latching surface at 76. Member 6 also includes a latch member at 80, which retains the member 6 in a preassembled position and includes a ramped surface at 82 and a latching surface at 84. Finally, member 6 includes extension fingers at 88 extending rearwardly from the body portion 60, as will be described herein.

Figure 5:
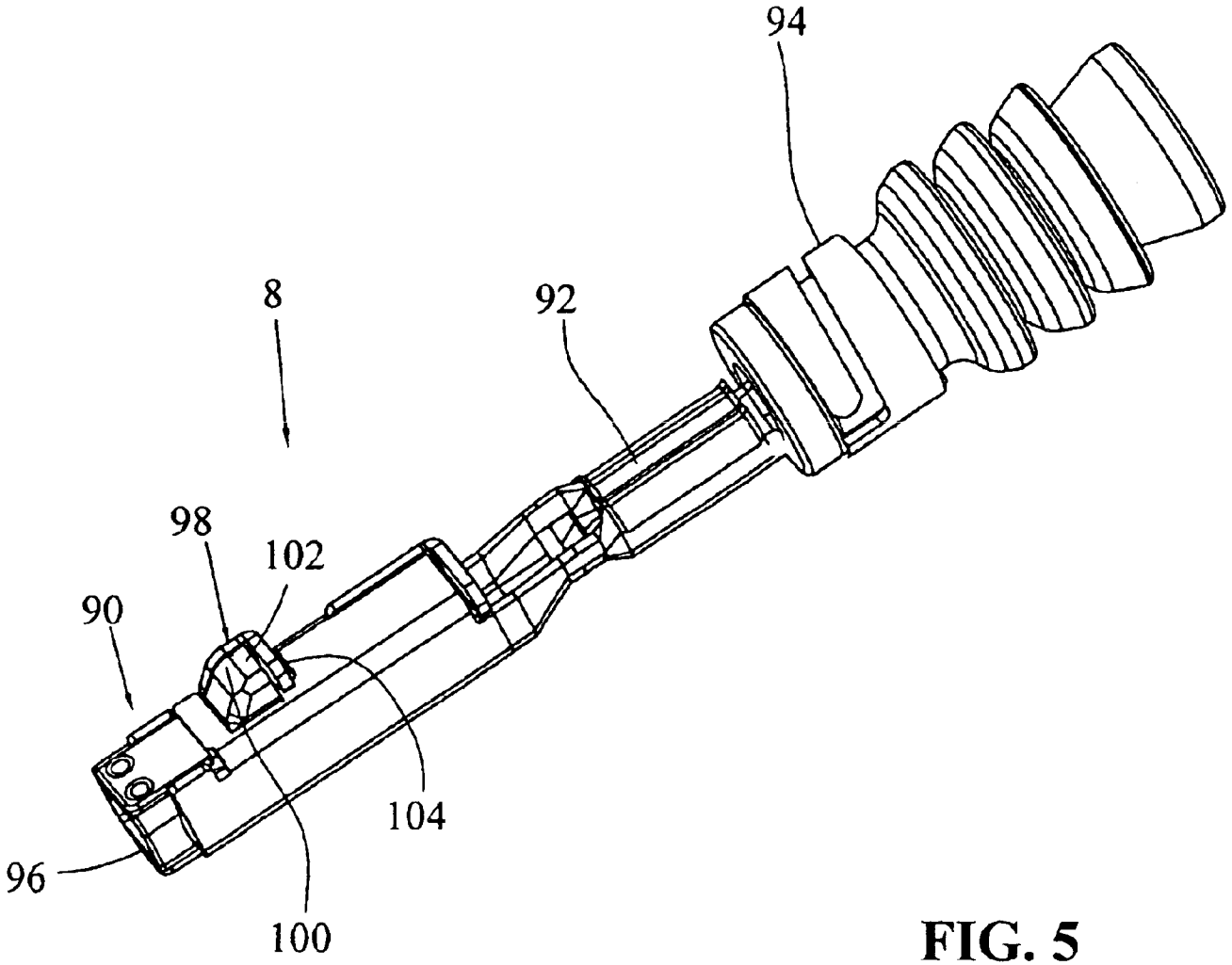
FIG. 5 is a perspective view of a terminal for use with the present invention.

With respect now to FIG. 5, electrical terminal 8 is shown in perspective view, where the electrical terminal includes a forward contact portion 90, an intermediate wire crimp section 92, and a strain relief section at 94. As should be appreciated, the electrical terminal includes a forward receptacle portion at 96, which is profiled to receive a mating electrical terminal or pin of a mating connector. As should also be appreciated, the electrical terminal is stamped and formed from a conductive metal, such as beryllium copper, although neither the specific material nor the overall contact configuration are particularly germane to the invention. However, the terminal does include an integrally formed projection shown best at 98, which includes a ramped surface at 100 and a top surface at 102.

Figure 6:
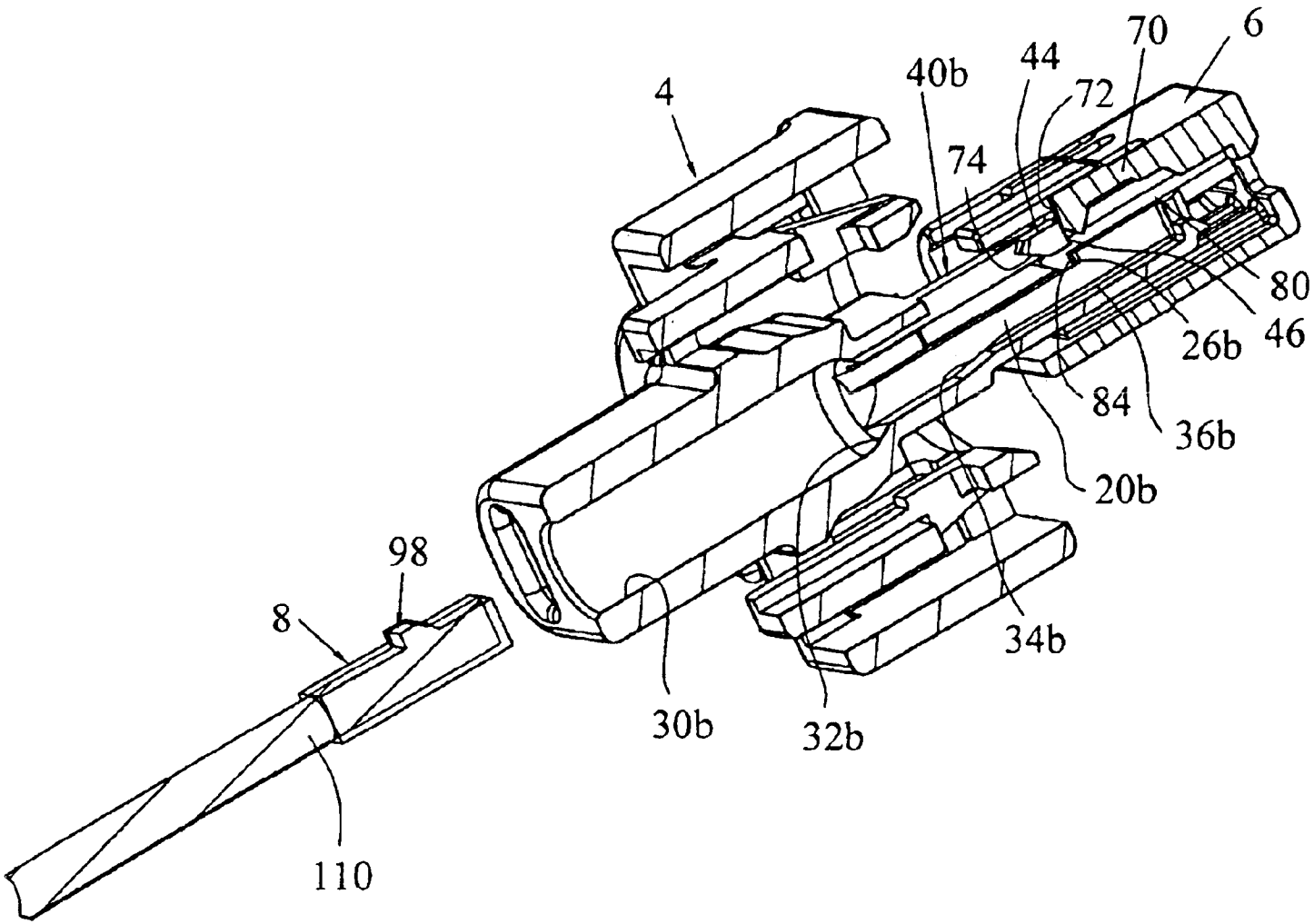
FIG. 6 is a perspective view of the housing and terminal position assurance member in a preassembled condition poised for receipt of a terminal and crimped wire.

With respect now to FIGS. 4 and 6, the initial assembly of the electrical connector will be described. As best shown in FIG. 6, the terminal position assurance member 6 is shown in a preassembled, latched condition to the housing 4 by way of latch shoulder 84 of latch extension 80 being positioned behind latch surface 26*b* of one of the channel side walls forming cavity 20*b*. It should be appreciated that the rearwardly facing latch extension 70 is centrally aligned with the latching bar 44, which extends between opposed walls 44. Thus, as shown in FIG. 6, in the preassembled position, surfaces 46 and 72 are shown in a substantially butting relation, where terminal position assurance member 6 cannot be moved rearwardly any further than the preassembled position. As also shown in FIG. 6, terminal 8 crimped to a wire 110 is poised for receipt within wire-receiving portion 30*b*, which again is in communication with channel 20*b*.

Figure 7:
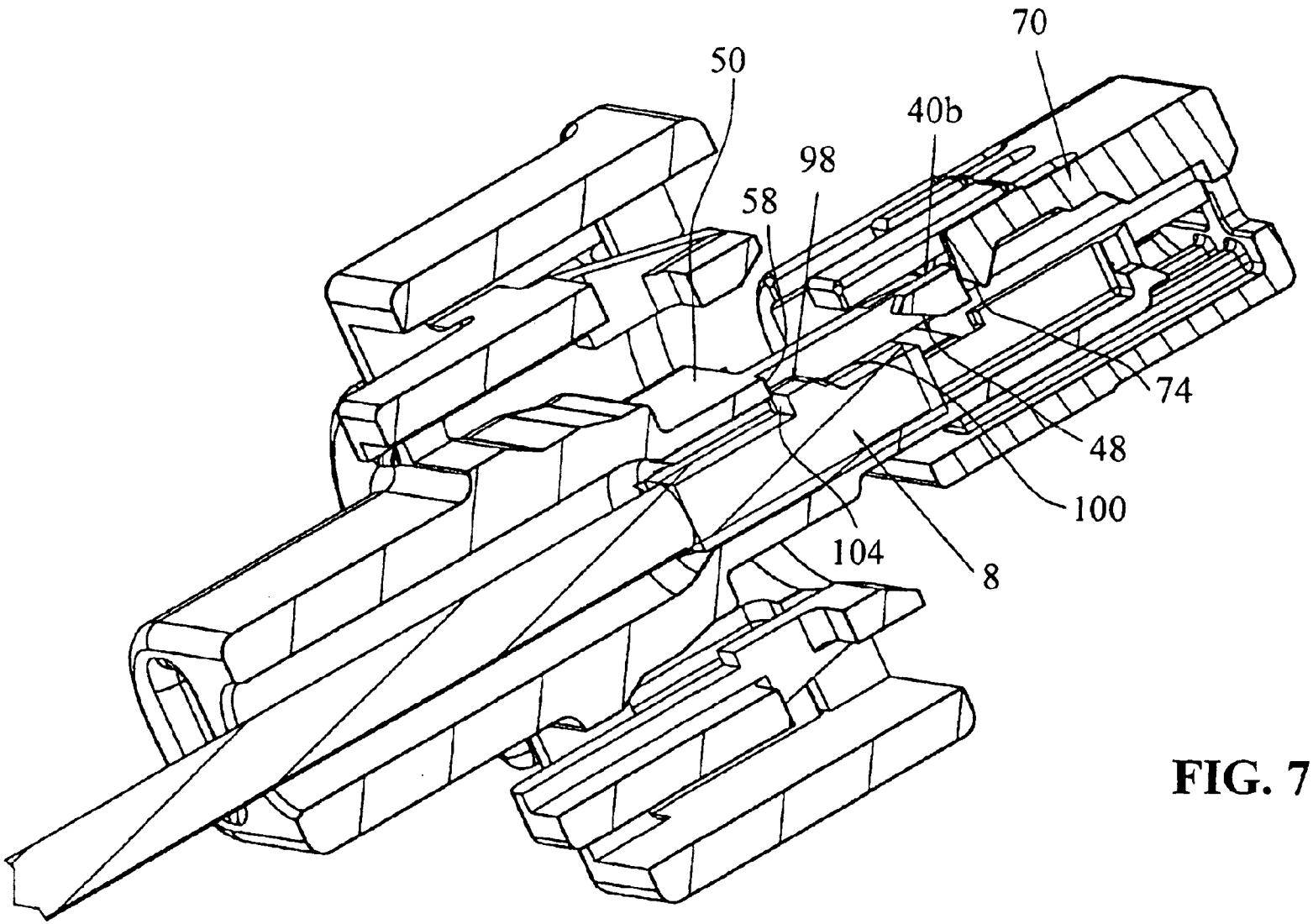
FIG. 7 shows a perspective view similar to that of FIG. 6 showing the wire in the terminal-receiving cavity.
Figure 8:
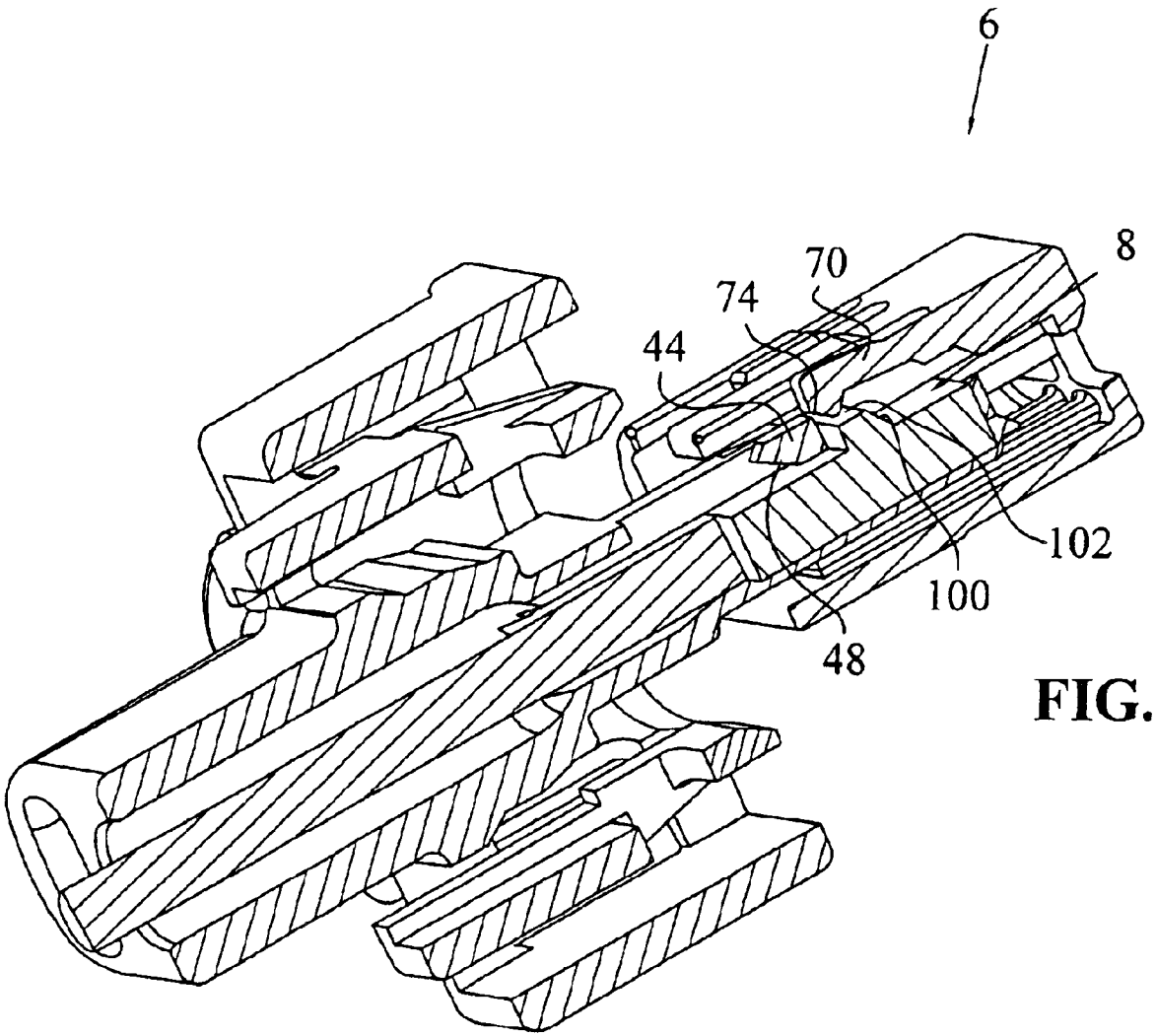
FIG. 8 shows a perspective view of the terminal deflecting a latch within the terminal position assurance member.
Figure 9:
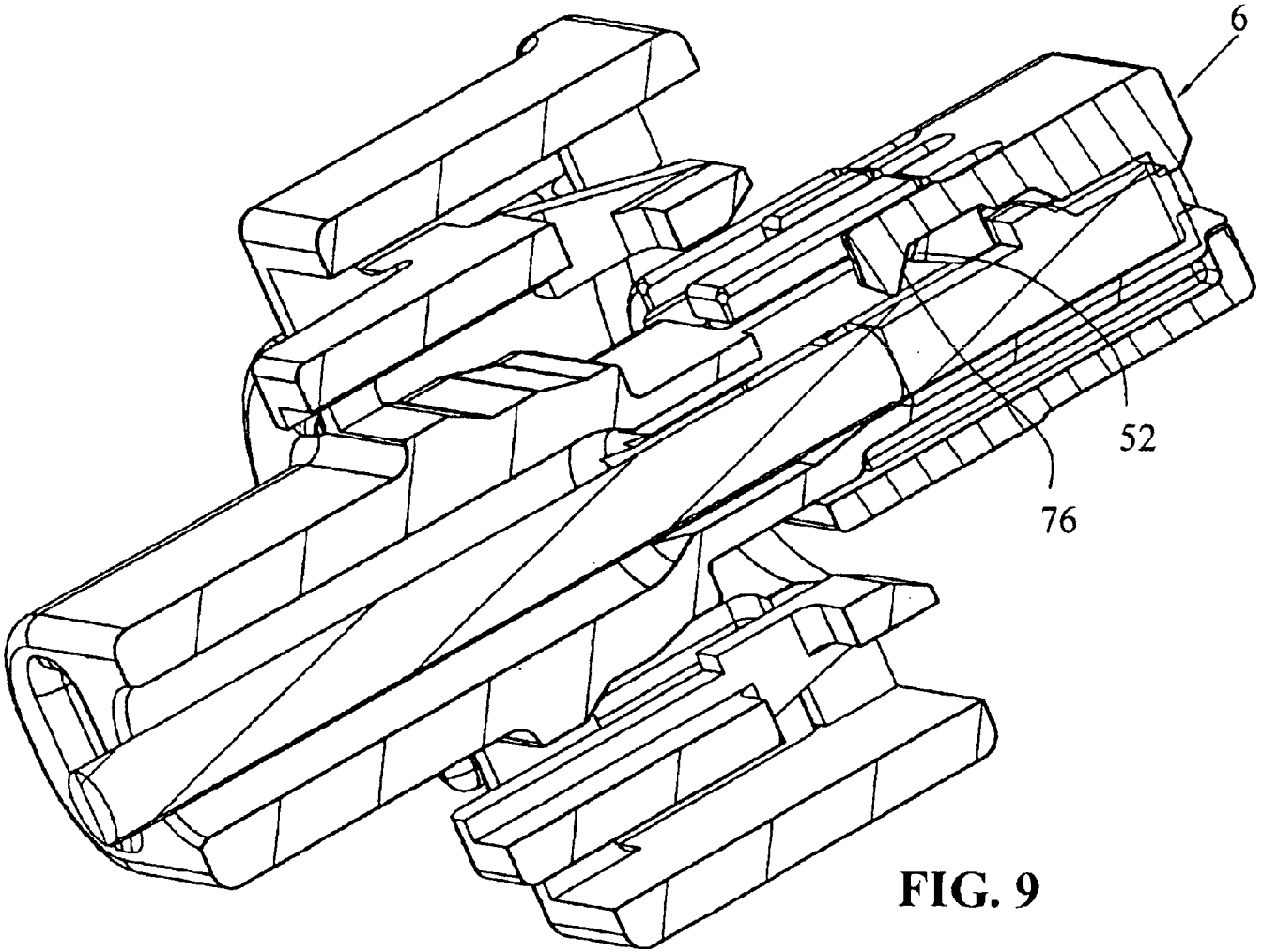
FIG. 9 shows the terminal position assurance member in its fully locked position.

Continued insertion of terminal 8 causes terminal 8 to pass over transitional walls 32*b* and 34*b* to reside on channel floor 36*b*. As shown in FIG. 7, this produces a prelatched position, where shoulder 104 of projection 98 is positioned behind forwardly facing edge 58 of body portion 50. When terminal 8 passes beneath latch member 40*b*, projection 98 contacts ramped surface 48, allowing the terminal 8 to be passed therethrough. Continued movement of the terminal into the passageway causes movement of the flexible latch arm 70 upwards by way of the interaction of ramping surfaces 100 and 74, such that the flexible latch biases into the position shown in FIG. 8. As shown in FIG. 8, the terminal 8 is shown in the fully inserted position, and given the deflection of the flexible latch arm 70, the terminal positioning assurance member 6 may now be moved rearwardly, such that ramped surface 74 (FIG. 8) can contact and cam flexible latch member 70 over the cross-bar portion 44 of latch 40*b*. The fully latched position of the terminal positioning assurance member 6 is therefore shown in FIG. 9. Cooperating surfaces 76 and 52 of latch 70 and cross bar 44, respectively, retain the terminal position assurance member in the fully assembled and locked position.

Advantageously, both the terminals and the terminal position assurance member have prelatched conditions relative to the housing 4, and the exact location of the terminal within the housing determines when the terminal positioning assurance member can be moved from the preassembled to the fully assembled position. Furthermore, the design is versatile as it is usable with multiple contact designs and latching structures.

What is claimed is:

1. An electrical connector, comprising:

a housing having at least one terminal receiving cavity extending from a rear wire entry to a front face of said housing, said housing having a front latching member extending forwardly adjacent to said front face, said front latching member having a front leading end;

a terminal positioning assurance member slidably receivable over said front face of said housing, said terminal positioning assurance member including a rearwardly facing, flexible latch member having a rearwardly facing stop surface aligned with said front leading end of said front latch member; and an electrical terminal member receivable into said terminal receiving cavity, said electrical terminal having a raised projection which is profiled for engaging and biasing outwardly, said rearwardly facing stop surface of said flexible latch member;

said terminal positioning assurance member being held in a pre-assembled position where said rearwardly facing stop surface of said flexible latch member abuts said front leading end of said front latch member, until said terminal is inserted into said cavity to a position where said raised projection deflects said flexible latch member, and said flexible latch passes over, and locks behind said front latching member in a fully assembled position.

2. The electrical connector of claim 1, wherein said terminal receiving cavity has an open upper face, and said front latching member extending partially over said open upper face, and said rearwardly facing, flexible latch member extending over said open upper face from an opposite position.

3. The electrical connector of claim 1, further comprising cooperable latching elements on said housing and terminal positioning assurance member to latch said housing and terminal positioning assurance member in said pre-assembled position.

4. The electrical connector of claim 3, wherein said cooperable latching elements are comprised of a cantilevered latching arm extending from said terminal positioning assurance member, engageable with a shoulder on said housing.

5. The electrical connector of claim 1, wherein said front latching member is defined by two spaced apart walls cantilevered from said housing, with a latching bar spanning between said walls, said flexible latching member locking to said latching bar in the fully assembled position.

6. The electrical connector of claim 5, wherein said latching bar includes a ramped surface on a lower edge thereof, which is profiled for engaging said raised projection on said terminal.

7. The electrical connector of claim 5, wherein said flexible latch member is defined by a cantilevered latch arm having a ramped surfacing sloping rearwardly upwardly, the ramping surface being profiled for engaging the latching bar and assisting in the deflection on the cantilevered latch arm over said latching bar.

8. The electrical connector of claim 1, wherein said electrical terminal includes a forward contact area, a wire crimp section and a strain relief section, said raised projection extending upwardly from said forward contact section.

9. The electrical terminal of claim 8, wherein said electrical terminal includes an inner contact member and an outer protective box-shaped cover, said raised projection extending upwardly from said outer protective box-shaped cover.

10. The electrical connector of claim 8, wherein said raised projection is comprised of a rearwardly extending ramped surface and a top surface.

11. An electrical connector, comprising a housing having at least one terminal receiving cavity extending from a rear wire entry to a front face of said housing, an electrical terminal member receivable into said terminal receiving cavity, and a terminal positioning assurance member slidably receivable over said front face of said housing, said housing having a front latching member extending forwardly adjacent to said front face, said front latching member having a front leading end, said terminal positioning assurance member including a rearwardly facing, flexible latch member having a rearwardly facing stop surface aligned with said front leading end of said front latch member, said terminal positioning assurance member being held in a pre-assembled position where said rearwardly facing stop surface of said flexible latch member abuts said front leading end of said front latch member, until said terminal is inserted into said cavity to a position where said terminal deflects said flexible latch member, and said flexible latch passes over, and locks behind said front latching member in a fully assembled position.

12. The electrical connector of claim 11, wherein said front latching member is defined by two spaced apart walls cantilevered from said housing, with a latching bar spanning between said walls, said flexible latching member locking to said latching bar in the fully assembled position.

13. The electrical connector of claim 11, wherein said terminal receiving cavity has an open upper face, and said front latching member extending partially over said open upper face, and said rearwardly facing, flexible latch member extending over said open upper face from an opposite position.

14. The electrical connector of claim 11, further comprising cooperable latching elements on said housing and terminal positioning assurance member to latch said housing and terminal positioning assurance member in said preassembled position.

15. The electrical connector of claim 14, wherein said cooperable latching elements are comprised of a cantilevered latching arm extending from said terminal positioning assurance member, engageable with a shoulder on said housing.

16. The electrical connector of claim 11, wherein said electrical terminal includes a raised projection being profiled for engaging and biasing outwardly, said rearwardly facing stop surface of said flexible latch member.

17. The electrical terminal of claim 16, wherein said electrical terminal includes an inner contact member and an outer protective box-shaped cover, said raised projection extending upwardly from said outer protective box-shaped cover.

18. The electrical connector of claim 16, wherein said electrical terminal includes a forward contact area, a wire crimp section and a strain relief section, said raised projection extending upwardly from said forward contact section.

19. The electrical connector of claim 18, wherein said raised projection is comprised of a rearwardly extending ramped surface and a top surface.

20. The electrical connector of claim 19, wherein said flexible latch member is defined by a cantilevered latch arm having a ramped surfacing sloping rearwardly upwardly, the ramping surface being profiled for engaging the latching bar and assisting in the deflection on the cantilevered latch arm over said latching bar.

* * * * *